US008410883B2

(12) United States Patent
Asplund et al.

(10) Patent No.: US 8,410,883 B2
(45) Date of Patent: Apr. 2, 2013

(54) HIGH VOLTAGE DRY-TYPE REACTOR FOR A VOLTAGE SOURCE CONVERTER

(75) Inventors: Gunnar Asplund, Solna (SE); Björn Jacobson, Grangesberg (SE)

(73) Assignee: ABB Technology AG, Zürich (CH)

( * ) Notice: Subject to any disclaimer, the term of this patent is extended or adjusted under 35 U.S.C. 154(b) by 231 days.

(21) Appl. No.: 12/675,820

(22) PCT Filed: Aug. 29, 2007

(86) PCT No.: PCT/EP2007/059003
§ 371 (c)(1),
(2), (4) Date: Oct. 25, 2010

(87) PCT Pub. No.: WO2009/026960
PCT Pub. Date: Mar. 5, 2009

(65) Prior Publication Data
US 2011/0025447 A1 Feb. 3, 2011

(51) Int. Cl.
*H01F 27/32* (2006.01)

(52) U.S. Cl. ..... 336/84 C

(58) Field of Classification Search ..... 336/84 R, 336/84 C, 192
See application file for complete search history.

(56) References Cited

U.S. PATENT DOCUMENTS

| | | | | |
|---|---|---|---|---|
| 3,708,875 | A * | 1/1973 | Martincic et al. | 29/605 |
| 4,569,000 | A * | 2/1986 | Noji | 361/730 |
| 5,218,185 | A * | 6/1993 | Gross | 219/528 |
| 7,868,724 | B2 * | 1/2011 | Sicong et al. | 336/84 R |

FOREIGN PATENT DOCUMENTS

| | | |
|---|---|---|
| CH | 230974 | 2/1944 |
| EP | 0 516 078 A | 12/1992 |
| JP | 59 074612 A | 4/1984 |
| WO | WO 2007/136307 A | 11/2007 |

OTHER PUBLICATIONS

International Search Report, dated Aug. 5, 2008, issued in connection with counterpart International Application No. PCT/EP2007/059003.

Written Opinion of the International Searching Authority, dated Aug. 5, 2008, issued in connection with counterpart International Application No. PCT/EP2007/059003.

* cited by examiner

*Primary Examiner* — Tuyen Nguyen
(74) *Attorney, Agent, or Firm* — Venable LLP; Eric J. Franklin

(57) ABSTRACT

A high voltage dry-type reactor is series-connected via a first terminal to an AC supply voltage and via a second terminal to the AC phase terminal of a high voltage converter and includes a cylindrical coil of insulated wire. In order to protect the reactor from a damaging DC field, the reactor further includes a metallic or resistive electrostatic shield which is connected to a same DC potential as the converter.

8 Claims, 4 Drawing Sheets

HIGH VOLTAGE DRY-TYPE REACTOR FOR A VOLTAGE SOURCE CONVERTER

CROSS-REFERENCE TO RELATED APPLICATIONS

This application is the national phase under 35 U.S.C. §371 of PCT/EP2007/059003 filed 29 Aug. 2007.

FIELD OF THE INVENTION

The invention relates to a high voltage dry-type reactor which is series-connected via a first terminal to an AC supply voltage and via a second terminal to the AC phase terminal of a high voltage AC/DC or DC/AC converter and which comprises a cylindrical coil of insulated wire. The converter is preferably a voltage source converter used in a high voltage direct current (HVDC) power transmission system.

BACKGROUND OF THE INVENTION

In today's power transmission and distribution systems, reactors are used to introduce an inductive reactance into the corresponding electrical circuit. A reactor can also be called an inductor. Its main component is a coil of insulated wire which can either be wrapped around a core of magnetic material, i.e. an iron core, or can be constructed in the form of a hollow body, i.e. a hollow cylinder or a hollow cuboid, with no magnetic material inside. The latter group of reactors is known as air-core reactors.

Reactors are used in power systems for example as filter reactors to filter out undesired harmonics in a current transmitted to a power network, as shunt reactors to compensate for capacitive reactive power, as neutral-grounding reactors to limit the line-to-ground current of a directly earthed network or as current-limiting reactors to limit short-circuit currents.

The winding of a reactor used under high-voltage and high-current conditions of a power system produces considerable heat. Therefore, appropriate cooling is necessary to reduce the temperature in the reactor coil in order to minimize the losses and to avoid thermal ageing of the insulating material. The cooling of an air-core reactor can be provided by insulating the reactor coil in a cooling fluid or by letting air flow alongside the coil windings. Air-cooled reactors are also known as dry-type reactors.

In high voltage direct current (HVDC) power transmission systems, power is transmitted between two AC power networks which are connected via a DC link. Accordingly, an AC/DC and a DC/AC converter are installed at one side of the DC link, respectively. The converters can be either of line commutated converter type or of voltage source converter type. In case of a line commutated converter, a reactor is used to remove current ripples on the DC side of the converter. This reactor is called a smoothing reactor. When voltage source converters are used in the HVDC system, additionally a reactor called converter reactor or phase reactor is used on the AC side of the converter to mainly block harmonic currents arising from the switching of the converter. Apart from blocking harmonic currents, the converter reactor serves the additional purposes of providing active and reactive power control and limiting short-circuit currents. Both reactor types and their arrangement in an HVDC system are for example known from the brochure "It's time to connect", issued by ABB Power Technologies AB, Grid Systems-HVDC, SE-771 80 Ludvika, Sweden, www.abb.com/hvdc.

SUMMARY OF THE INVENTION

The present invention deals with a converter reactor, i.e. a reactor connected in series to the AC side of a high voltage AC/DC or DC/AC converter, preferably a voltage source converter. Such converter reactors are usually dry-type reactors, i.e. no insulating oil is used.

A commonly known AC/DC or DC/AC part of a HVDC system with voltage source converter is shown in a single-line diagram in FIG. 1. Usually, the AC part of a HVDC system contains three phases. A voltage source converter (VSC) 1 comprises converter valves 2 connected in a known bridge configuration, where the converter valves 2 each comprise an IGBT 3 (Insulated Gate Bipolar Transistor) in anti-parallel connection with a free-wheeling diode 4. The VSC 1 is connected on its AC side to a converter reactor 5, followed by a harmonic filter 6 and a transformer 7. The transformer 7 is coupled to an AC power network 8. Two identical, series-connected capacitor units 9 are connected between a first pole 12 and a second pole 13 of the DC side of the VSC 1, and the DC link of the HVDC system is in this example made up of two DC cables 10. The DC cables are insulated and their shields are grounded. Instead of DC cables, overhead lines may be used as well. The connection point 11 between the two capacitor units 9, also called the midpoint or midpotential of the DC side of VSC 1, is grounded, so that a symmetrical DC voltage occurs between the two poles 12 and 13. Accordingly, the DC cable 10 connected to the first pole 12 has a positive voltage potential $+U_{DC,1}$ and the DC cable 10 connected to the second pole 13 has a negative voltage potential $-U_{DC,1}$ with the same absolute value as the positive voltage potential.

New developments in HVDC technology suggest an asymmetric system, where instead of the midpoint between the capacitor units 9 one of the poles 12 or 13 is grounded. In FIG. 2, such an asymmetric system is shown where the first pole 12 is connected to ground and the second pole 13 is connected to a DC cable 10. The voltage potential on the DC cable 10 is negative ($-U_{DC,2}$) and has usually a different value than the negative voltage potential ($-U_{DC,1}$) in the symmetrical configuration of FIG. 1. Since a DC cable constitutes a considerable cost factor in a HVDC system, a reduction from two to one cable results in a major cost reduction. A similar asymmetric configuration can be set up using only one overhead line instead of two, the remaining pole being connected to earth. This solution would not only mean that less material is needed for the overhead lines, but it would also result in the reduction of transmission losses since the earth has a much smaller resistance than an overhead line.

It is an object of the present invention to provide a converter reactor which is suitable to be used in the asymmetric configuration of an HVDC system.

The invention is based on the recognition of a fundamental problem arising in the asymmetric configuration. The problem is caused by the fact that an asymmetric configuration of the HVDC system results in a DC offset on the AC side of the VSC 1, which is opposed to the symmetric case where no DC offset occurs. The DC offset results in a DC electric field between the converter reactor 5 and ground which leads to the accumulation of charges on the insulating outer and inner surfaces of the reactor 5. This situation is depicted in FIG. 3*a*, where a converter reactor 5 is shown schematically, comprising a cylindrical coil of insulated wire 14 which is surrounded by an insulating cylinder 15. The insulating cylinder 15 is placed on two insulators which stand on a ground 17. The winding of the coil 14 is electrically connected on one side via a first terminal A to a connection point on the secondary side of the transformer 7 (see FIG. 2) and on the other side via a second terminal B to the AC phase terminal 35 of converter 1. Accordingly, the terminal A sees the DC offset potential plus the AC voltage of the secondary transformer side and the terminal B sees the DC offset potential plus the switching voltage of the converter 1. Since the DC potential is of negative value in the example of FIG. 2, the resulting charges 18 on the surface of the insulating cylinder 15 are positive. The charges 18 accumulate not only on the outer surface of the insulating cylinder 15 as in FIG. 3*a*, but also on its inner surface from where they may affect the winding of coil 14. FIG. 3*b* shows a cross section of some turns of the wire 19 of coil 14. The wire 19 is surrounded by a thin layer 20 of insulating material. This insulating layer 20 is usually thick enough to withstand the normal AC electric fields of a symmetric HVDC system, but in the asymmetric case, the increased field strength could lead to puncturing, i.e. flashes through the insulating layer 20, which would damage the insulating material. The charges 18 could propagate between the windings and finally lead to the destruction of the reactor or even a fire.

In order to prevent the damaging of the converter reactor caused by the DC field, the invention suggests to install a metallic or resistive electrostatic shield at the reactor, where the shield is connected to a same DC potential as the converter. The connection can be made to either the DC side or to the AC side of the converter. On the AC side, terminals A or B are chosen since they see the converter's DC potential as explained above. The shield eliminates the DC field around the converter reactor and thereby prevents the appearance of dangerous charges on the surface of the reactor winding. Puncturing and destruction of the converter reactor can effectively be avoided, accordingly.

BRIEF DESCRIPTION OF THE DRAWINGS

The invention is now described by way of example with reference to the accompanying drawings in which.

DETAILED DESCRIPTION OF EMBODIMENTS OF THE INVENTION

Figure 3A:
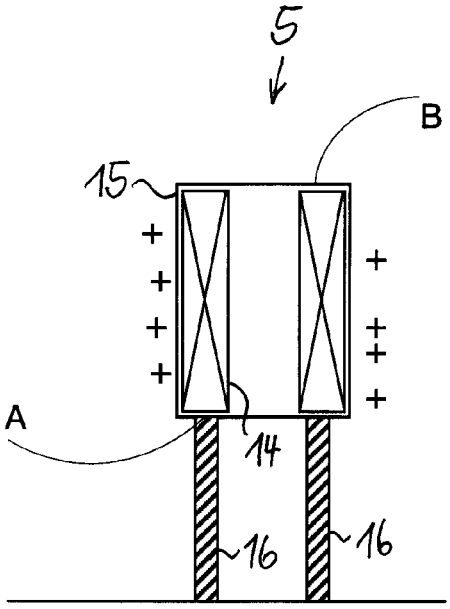
FIG. 3*a* shows the charging of a converter reactor in an asymmetric HVDC system.
Figure 3B:
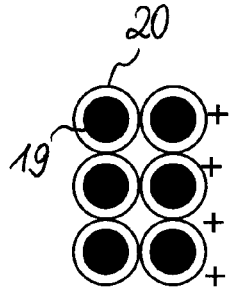
FIG. 3*b* shows the charging of the turns of the converter coil of FIG. 3*a*.
Figure 4:
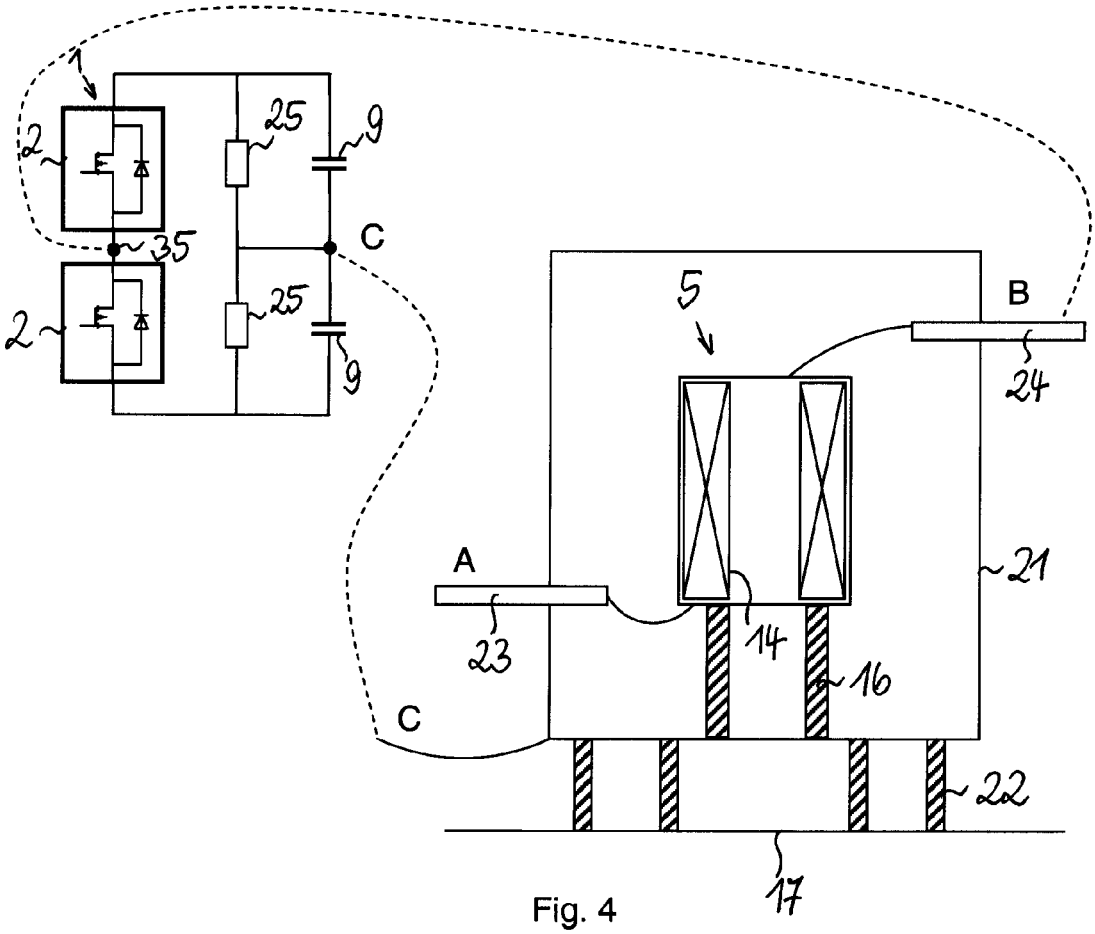
FIG. 4 shows a converter reactor with a metallic cage connected to a DC potential on the DC side of the converter.

A first embodiment of the invention is shown in FIG. 4. There, the converter reactor 5 of FIG. 3*a* is enclosed in a metallic cage 21, which is lifted via insulators 22 above ground 17. The metallic cage 21 is a hollow body which can be cylindrical or of any other three-dimensional shape, and which has a bottom and a roof. The cage 21 can for example be made of sheet or meshed metal or of wires with different profiles. Bushings 23 and 24 are led through the wall of the cage 21 in order to connect the ends of coil 14 from the outside to the connection points corresponding to terminals A or B, respectively. The cage 21 is electrically connected to a DC potential on the DC side of the converter, which is in this special embodiment the midpotential at midpoint C. The connection to the DC potential is beneficial from the point of view of possible radio interference. Resistors 25 are connected in parallel to the capacitors 9 on the DC side of converter 1, and the midpoint of their series connection is connected to midpoint C in order to stabilize the DC voltage distribution. In a further embodiment of the invention, the metallic cage 21 is identical with a magnetic shield of the converter reactor 5, i.e. the cage 21 fulfils two functions at the same time: it eliminates the DC field on the reactor coil 14 and it mitigates or eliminates magnetic fields outside the reactor.

Figure 1:
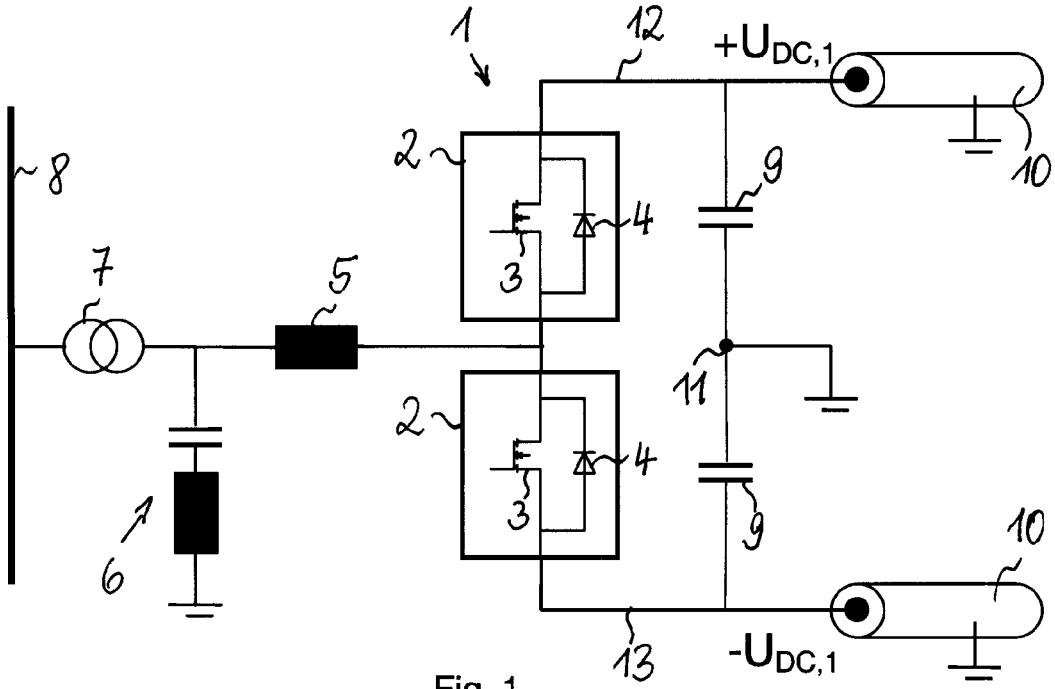
FIG. 1 shows a known symmetric HVDC system.
Figure 2:
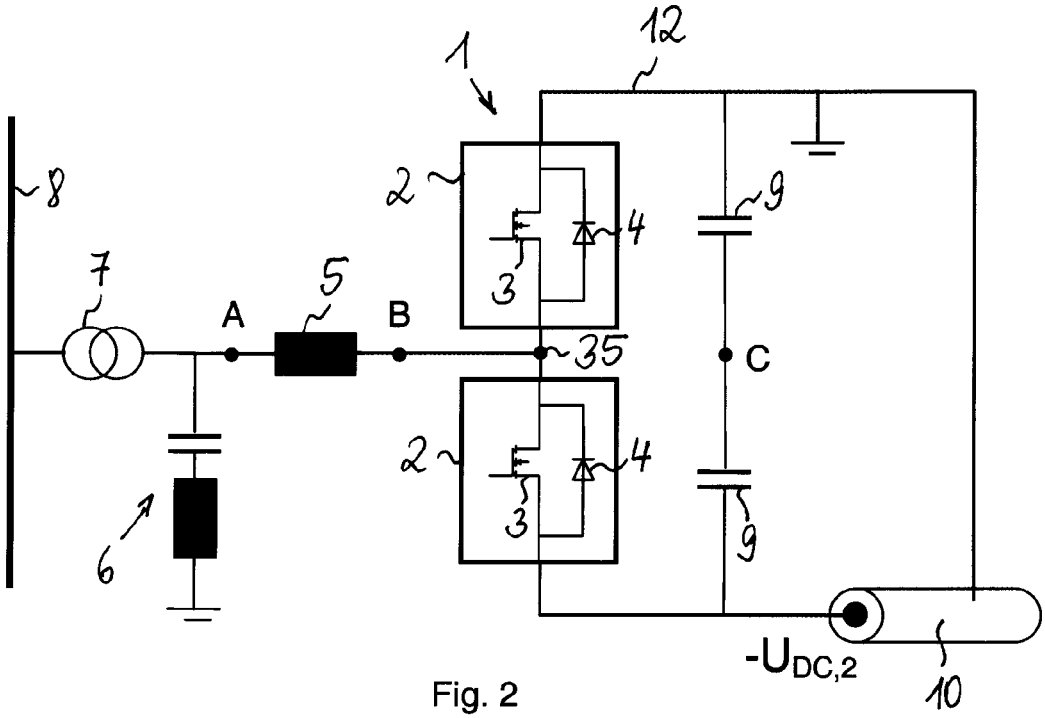
FIG. 2 shows a known asymmetric HVDC system.
Figure 5:
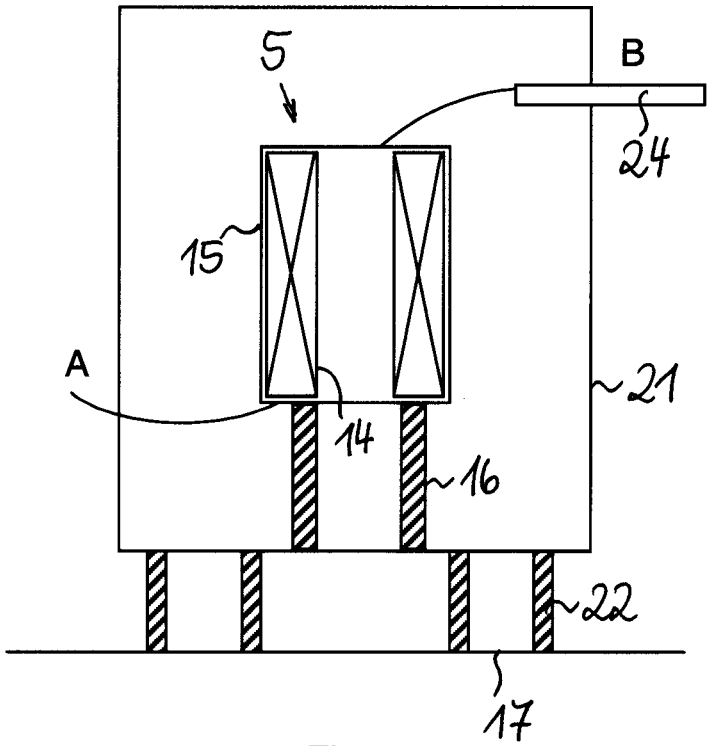
FIG. 5 shows a converter reactor with a metallic cage connected to a DC potential on the AC side of the converter via a first terminal.
Figure 6:
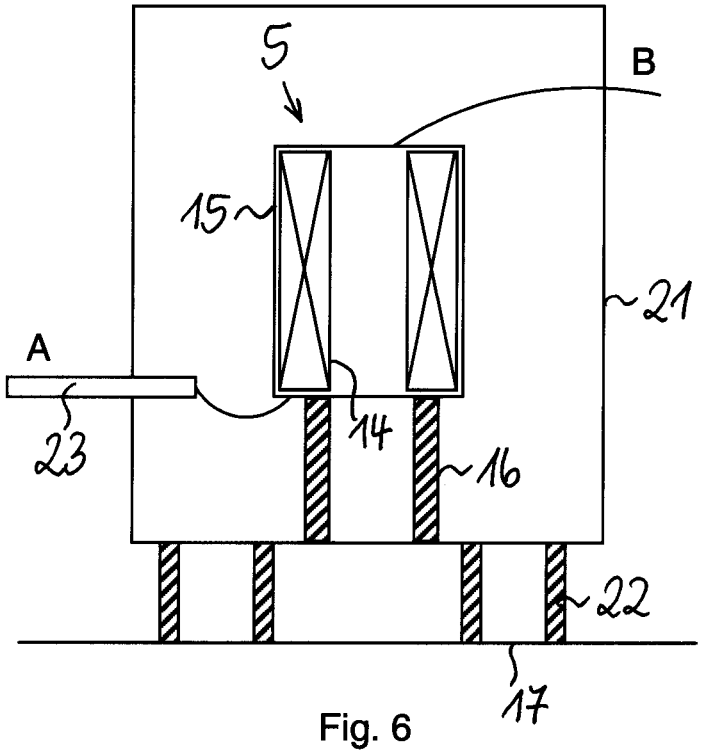
FIG. 6 shows a converter reactor with a metallic cage connected to a DC potential on the AC side of the converter via a second terminal.

In FIG. 5, the reactor 5 of FIG. 3*a* is again enclosed in the metallic cage 21 of FIG. 4. Instead of connecting the cage 21 to a DC potential on the DC side of the converter, the cage 21 is connected directly to terminal A of the reactor and thereby to the connection point on the secondary side of transformer 7 in FIG. 2. Bushing 23 as well as the connection to the point C (FIG. 4) is thereby omitted. FIG. 6 distinguishes from the embodiment in FIG. 5 only in that the cage 21 is connected to terminal B instead of terminal A and is thereby connected to the AC phase terminal of converter 1 (FIG. 4). In this embodiment, bushing 24 as well as the connection to the point C (FIG. 4) is omitted.

Figure 7:
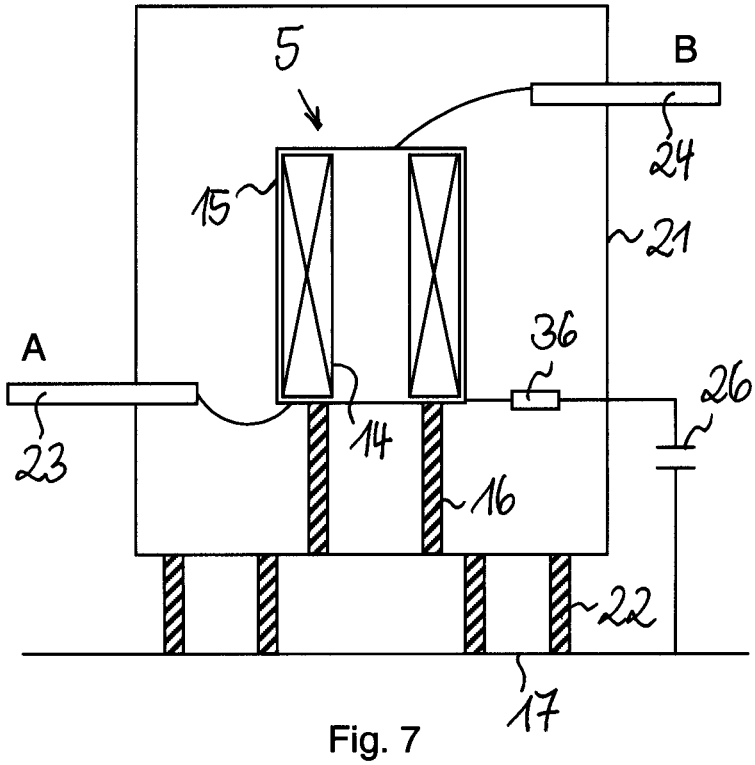
FIG. 7 shows a converter reactor with a metallic cage, which is high-frequency connected to ground.

FIG. 7 shows another embodiment of the invention. The arrangement is almost identical to the one of FIG. 5. The only difference is that the cage 21 is connected via a resistor 36 to the potential of terminal A of the reactor 5 and via a capacitor 26 to ground 17. The time constant of the resistive-capacitive connection is preferably chosen in the range of seconds or larger, and it establishes a strong high-frequency coupling of the cage to ground in order to mitigate high frequency voltage disturbances arising from the switching of the converter valves 2. Alternatively, the high-frequency coupling of FIG. 7 could also be applied to the embodiments of FIG. 4 or 6.

Figure 8:
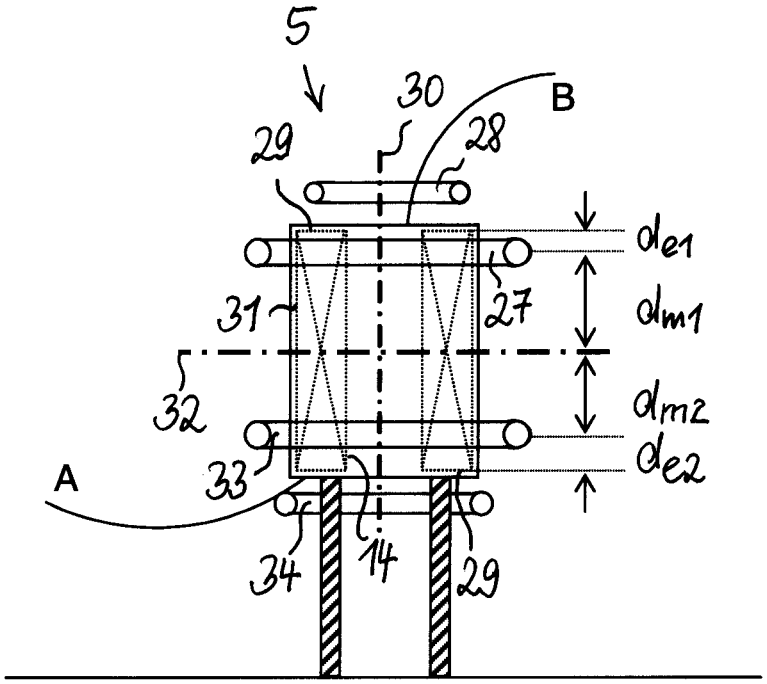
FIG. 8 shows a converter reactor with corona rings.

A still further embodiment according to FIG. 8 is not based on a metallic cage, but instead two first corona rings 27 and 33 are each placed around one of the two ends of the cylinder of coil 14. Additionally, two second corona rings 28 and 34 are each placed in parallel to one of the two end surfaces 29 of the cylinder of coil 14. . Corona rings 33 and 34 are electrically connected to the first terminal A of the reactor 5 and the other corona rings 27 and 28 on the opposite end of coil 14 are electrically connected to the second terminal B of the reactor 5. The four corona rings 27, 28, 33 and 34 are all placed so that the longitudinal axis 30 of the cylinder of coil 14 and the central axis of the rings are in line with each other. Each of the first corona rings 27 surrounds the shell 31 of the cylinder of coil 14 at a distance $d_{e1}$ or $d_{e2}$ from the respective end surface 29 which is shorter than the respective distance $d_{m1}$ or $d_{m2}$ from the lateral middle axis 32 of the coil cylinder. By placing the four corona rings 27, 28, 33 and 34 on top and on the outer sides of the coil 14 and thereby the reactor 5, it is prevented that any charges flow into the interior of the reactor 5. In a special embodiment, the corona rings are arranged to reduce the flow of induced currents inside the rings in order to avoid excessive magnetic heating. This is achieved by using a highly resistive material and/or by choosing a cross-section for the rings, which encloses as little magnetic field as possible.

The invention claimed is:

1. A high voltage dry-type reactor which is series-connected via a first terminal to an AC supply voltage and via a second terminal to an AC phase terminal of a high voltage converter being part of an asymmetric configuration of a high voltage direct current system, the reactor comprising:

a cylindrical coil of insulated wire, and a metallic or resistive electrostatic shield which is connected to the first or second terminal of the reactor.

2. The reactor according to claim 1, wherein the electrostatic shield comprises two first corona rings, each placed around one of the two ends of the cylinder of the coil so that the longitudinal axis of the cylinder and the central axis of the rings are in line with each other and so that each of the rings surrounds the shell of the cylinder at a distance from the respective end surface of the cylinder which is shorter than the distance from the lateral middle axis of the cylinder, wherein one of the two first corona rings is electrically connected to the first terminal of the reactor, and wherein the other of the two first corona rings is electrically connected to the second terminal of the reactor.

3. The reactor according to claim 2, wherein the electrostatic shield further comprises two second corona rings, each placed in parallel to one of the two end surfaces of the cylinder of the coil so that the longitudinal axis of the cylinder and the central axis of the rings are in line with each other, wherein one of the two second corona rings is electrically connected to the first terminal of the reactor, and wherein the other of the two second corona rings is electrically connected to the second terminal of the reactor.

4. The reactor according to claim 2, wherein the corona rings are arranged to reduce the flow of induced currents inside the rings by choosing a cross-section for the rings, which encloses as little magnetic field as possible, and/or by using a highly resistive material.

5. The reactor according to claim 1, wherein the electrostatic shield comprises a metallic cage which surrounds the coil and which is connected to the first or the second terminal of the reactor.

6. The reactor according to claim 5, wherein the cage is via a high voltage resistor coupled to the first or second terminal of the reactor and is coupled to ground via a capacitor.

7. The reactor according to claim 6, wherein the resistor is connected between the cage and the reactor and the capacitor is connected between the cage and ground.

8. The reactor according to claim 1, wherein the converter is a voltage source converter for a high voltage direct current power transmission system in asymmetric configuration.

* * * * *

UNITED STATES PATENT AND TRADEMARK OFFICE

CERTIFICATE OF CORRECTION

PATENT NO. : 8,410,883 B2
APPLICATION NO. : 12/675820
DATED : April 2, 2013
INVENTOR(S) : Jacobson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 469 days.

Signed and Sealed this
Twenty-first Day of October, 2014

Michelle K. Lee

Michelle K. Lee
*Deputy Director of the United States Patent and Trademark Office*